United States Patent [19]

Guimarin

[11] 4,397,403

[45] Aug. 9, 1983

[54] CONTAINER OPENING APPARATUS WITH CAPTURED TAB

[75] Inventor: Henry L. Guimarin, Dallas, Tex.

[73] Assignee: Guimarin Container Co., Incorporated, Dallas, Tex.

[21] Appl. No.: 303,395

[22] Filed: Sep. 18, 1981

[51] Int. Cl.[3] ..... B65D 17/34

[52] U.S. Cl. ..... 220/269

[58] Field of Search ..... 220/269–273

[56] References Cited

U.S. PATENT DOCUMENTS 3,327,891 6/1967 Smyth ..... 220/269

3,386,613 6/1968 Traynor ..... 220/269

3,795,341 3/1974 Ostrem ..... 220/269

*Primary Examiner*—George T. Hall

*Attorney, Agent, or Firm*—Kanz & Timmons

[57] ABSTRACT

Disclosed is a container end with an integral opening apparatus which includes pull means for tearing a tab defined by a score line from the container end to form an opening. The score line is substantially U-shaped and the pull means is attached on the tab near the base of the U. Since the score line is U-shaped, the top of the U which defines one end of the tab is not severed from the container, thus the tab may be folded over the edge of the container end and maintained in a captured position out of the way of the user.

11 Claims, 9 Drawing Figures

CONTAINER OPENING APPARATUS WITH CAPTURED TAB

This invention relates to self-contained opening means for containers. More particularly, it relates to sealed containers with self-contained apparatus for forming an opening in such containers in which the opening means and the portion of the container removed to form the opening remains secured to the container.

Various materials such as foods (both liquid and solid), beverages (such as liquids containing dissolved gasses such as carbon dioxide), as well as other liquid, solid, gaseous, granular or powdered materials and the like, are commonly sold to the consuming public in convenience-sized sealed containers. Many such containers, such as those used for beverages and the like, are hermetically sealed to retain dissolved gasses, etc., within the container. The contents of such containers are usually consumed immediately after opening the container, thus it is unnecessary to re-seal the container. Therefore, any means for forming an opening in the container is suitable for removing the contents therefrom. However, it has become common practice to provide convenient self-opening apparatus with the container so that the container may be readily opened when desired without resorting to use of separate opening tools.

Heretofore the most common self-contained means for opening such containers results in the complete separation and removal of a tab from the end of the container to form an opening. Commonly, a metal container end, made of aluminum or an aluminum alloy or the like, is scored to form a weakening groove in the container end which defines a removeable tab. A leverage ring or the like is attached to the tab thus defined so that when the ring is raised or pulled, the container end is torn along the weakening groove and the tab separated and removed from the container end.

When the tab and leverage ring are removed from the container, they are usually discarded and present an ecological hazard. Accordingly, in order to avoid the ecological hazard, it is desirable that alternative self-opening means be provided wherein the tab defining and forming the opening remains attached to the container. Various prior attempts have been made at designing such self-contained opening systems, all of which have certain limitations and some of which have met with limited success. For example, container ends have been formed which include a pre-cut opening covered by a sealing film which may be stripped from the opening but remain attached to the container. This apparatus advantageously avoids detaching the tab from the container but has been found unsuitable for many uses because a reliable seal is difficult and expensive to achieve, a gas-impervious film is expensive to produce, and the film is much more fragile than the container end and thus is easily accidentally ruptured. Container ends have also been used in which a score line or weakening groove is formed to define a partially removable tab which is adapted to be deflected inwardly, thus forming an opening but maintaining the tab secured to the container end. Among the major disadvantages of this apparatus are that the opening apparatus is difficult to manipulate and the inwardly deflected tab usually partially blocks the opening. Moreover, the inwardly deflected tab is deflected into the interior of the container, thus exposing the contents of the container to debris, contamination or other unsanitary conditions existing on the external surface of the container end.

In accordance with the present invention, the foregoing disadvantages are obviated by providing a container-opening apparatus in which the opening tab is drawn outwardly from the container but remains attached to the container, thus it cannot be removed and individually discarded. However, the portion of the tab severed from the container end is neatly and conveniently folded and secured away from the opening so as to not interfere with the opening formed or the user of the container. The container end of the invention include a score line or weakening groove which defines a tab to be partially removed from the end. The scored groove, however, is basically U-shaped in plan outline so that the tab defined thereby may only be partially separated from the container end. The portion of the tab at the top of the U remains an integral part of the container end forming a hinge by which the tab may be folded away from the opening and out of the way of the consumer, but which retains the tab fully connected to and thus captured by the container. The opening arrangement of the invention may be formed using conventional materials and techniques by re-arranging the shape and physical location of various conventional parts and re-arranging the configuration of the score pattern. Thus the container end of the invention may be manufactured as inexpensively as conventional removeable tab container ends. However, the captured tab formed in accordance with the invention remains attached to the container while opening outwardly, thus avoiding the inconvenience and contamination problems associated with prior captured tabs. Furthermore, the opening arrangement of the invention is as easily and conveniently used as prior separately discardable tab container ends. Thus it will be more readily accepted by the consuming public than prior captured tab arrangements yet provide all the advantages of conventional separately discardable tab arrangements.

Other features and advantages of the invention will become more readily understood when taken in connection with the appended claims and attached drawings in which:

Figure 1:
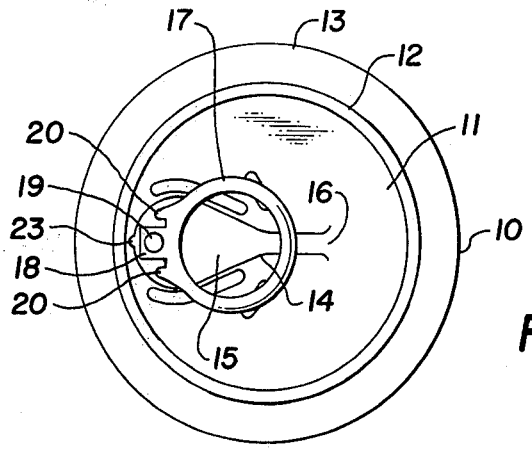
FIG. 1 is a top plan view of a sealed container employing the preferred embodiment of the invention.

As illustrated in the drawings, the invention is described herein with reference to a cylindrical container 10 which is hermetically sealed and closed by a substantially flat and substantially circular container end disc 11. As illustrated, the container end 11 is secured to the top end of the container 10 by a conventional rolled or folded bead 12. In the particular embodiment illustrated, the top end of the container 10 is reduced in diameter to form a neck portion 13, thereby reducing the dimensions of the container end 11 to reduce manufacturing costs. The container 10 and container end 11, except for the shape and arrangement of the self-opening apparatus, as well as the methods employed in connecting the container 10 and the container end 11 to form a sealed container, are conventional and well-known to those skilled in the art.

In accordance with the invention, a score line or weakening groove 14 is formed in the surface of the container end 11 by conventional means to define a tab which, when removed from the container end, forms an opening in the container end. The weakening score defines a tab 15 which is substantially U-shaped. The base of the U is substantially wider than the top of the U, thus defining an elongated tab which is substantially symmetrical about its longitudinal axis. The base of the U, referred to herein as the first end of the tab, is located near one edge of the container end 11 with the tab 15 disposed to extend across the face of the container end disc. The ends of the score line which define the top of the U are spaced apart and define the opposite or second end 16 of tab 15. As illustrated in the drawings, the second end 16 or tab 15 is positioned substantially diametrically disposed from the first end and somewhere between the geometric center of the container end disc 11 and the edge thereof opposite the first end of tab 15. Since the ends of the score line are spaced apart, the second end 16 of tab 15 is not readily separable from the container end disc 11.

An elongated body comprising a pull means, such as ring 17 having a substantially flat edge portion 18, is rotatbly attached to the tab 15 near the first end thereof by means of a rivet 19 or the like which is securely fastened to or through the first end of the tab 15 and extends through the flat end portion 18 of ring 17. Thus ring 17 may be rotated about the rivet 19 in a plane parallel with the container end 11.

Figure 6:
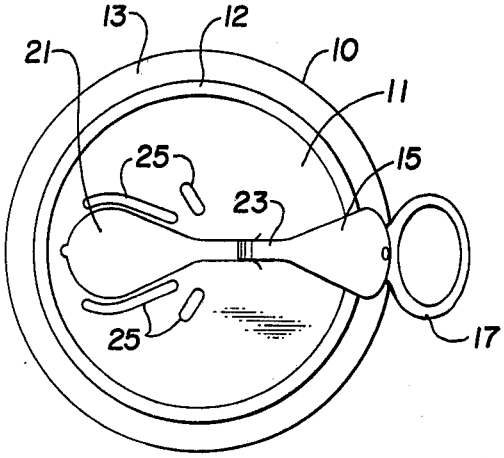
FIGS. 6 and 7 are a top plan view and a side elevational view, respectively, of the apparatus of FIG. 1 illustrating the relative positions of the parts during the final stages of the opening procedure.
Figure 8:
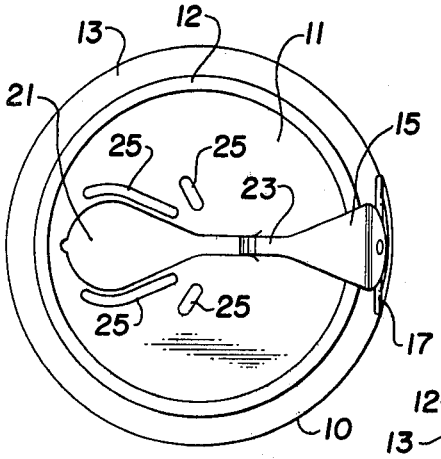
FIGS. 8 and 9 are a top plan view and a side elevational view, respectively, of the apparatus of FIG. 1 after the opening procedure has been completed.

In the preferred embodiment, the pull means or ring 17 includes a pair of boss members 20 which extend from the ring parallel with and on opposite sides of the flat edge portion 18. The ends of boss members 20 protrude upwardly from the plane of the ring 16 as more clearly illustrated in FIGS. 2 and 4. As with conventional pull-tab opening arrangements, an opening 21 (as shown in FIGS. 6 and 8) is formed in the container end 11 by tearing the tab 15 from the container end along the weakened score line. However, in conventional pull-tab openings, the pull ring is secured to the tab at the narrow point of the tab (near the center of the container end) and the tab torn outwardly toward the edge to completely sever the tab from the container end. In accordance with this invention, the pull ring is secured to the widened portion of the tab 15 near the first end (the widened end thereof nearest the edge of the container end) and pulled toward the opposite edge of the container end 11. Since the second end 16 of tab 15 is not severable from the container end, the tab 15 remains attached to the container end 11.

Figure 2:
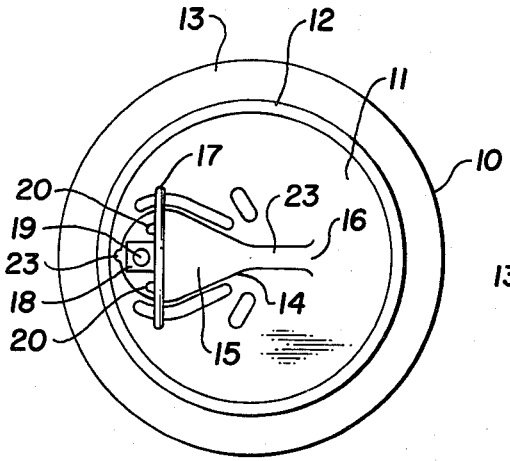
FIGS. 2 and 3 are a top plan view and side elevational view, respectively, of the apparatus of FIG. 1 illustrating the relative positions of the parts after completion of the first step of the opening procedure.
Figure 3:
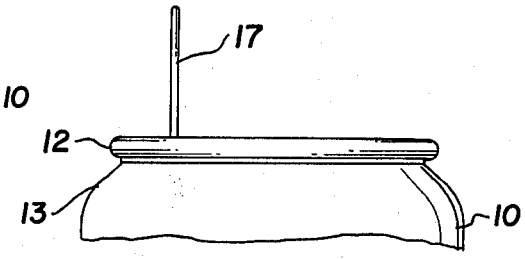
Figure 4:
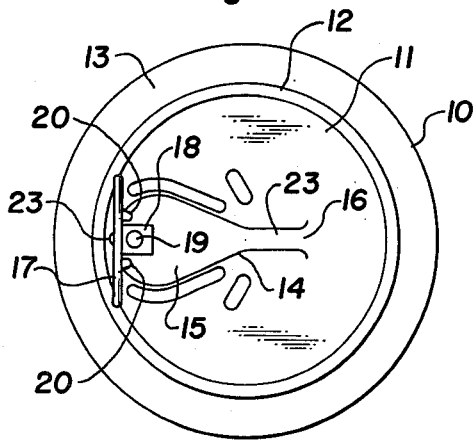
FIGS. 4 and 5 are a top plan view and a side elevational view, respectfully, of the apparatus of FIG. 1 illustrating the relative positions of the parts after completion of the second step of the opening procedure.
Figure 5:
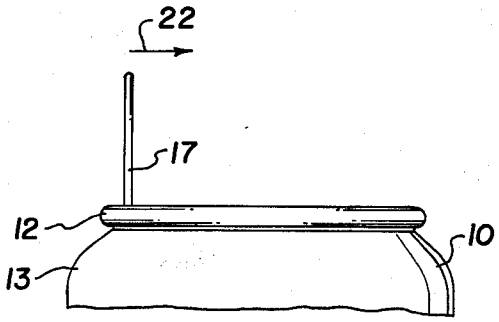

The preferred embodiment of the invention is illustrated in the closed condition ready for shipment or use in FIG. 1. To operate the opening apparatus, the pull ring 17 is pivoted upwardly. As illustrated in FIG. 2, when the pull ring 17 is tilted upwardly the flat edge portion 18 which is attached to the tab by means of rivet 19 remains parallel with the tab 15 and is thus bent 90° from the ring 17. As also illustrated in FIG. 2, when the ring 17 is pivoted 90° from the tab, the end portions of bosses 20, which extend 90° from the plane of the ring, extend parallel with and lie adjacent the first end of the tab 15 on opposite sides of the flat edge portion 18. During this first step of the opening process, the flat edge portion 18 is bent but preferably no portion of the tab 15 is severed from the container end. Thereafter, the ring 17 and flat edge portion 18 are rotated approximately 180° about the rivet 19 to the position shown in FIGS. 4 and 5. As shown in FIGS. 4 and 5, the pull ring 17 is positioned between the rivet 19 and the edge of the container end 11.

To initiate the actual opening sequence, the top end of ring 17 is drawn toward the center of the container end disc 11 as indicated by arrow 22 in FIG. 5. It will be observed that as the ring 17 is drawn inwardly, bosses 20 engage the top of the first end of the tab 15, thus stabilizing the ring and forcing the extreme end of the first end of tab 15 upwardly with respect to the container end 11. This results in localizing the initial break point along the score line so that only the extreme end of the first end of tab 15 is initially severed from the container end along the score line. Since the first end of the tab as defined by the score line is a relatively wide end, the initial break point where the end is initially severed along the score line should be somewhat localized to aid in initiating an even tear and to reduce the force required to initiate a tear. As a further aid in localizing the initial break point, the score line defining the first end of the tab may define a relatively narrow curved extension 23 of the first end of tab 15. Since the extension 23 is a relatively narrow curved tip, the initial break point will be narrowly confined and thus severing of the tab from the container end will be more readily initiated at the desired central point at the base of the widened end of the U-shaped tab.

Figure 7:
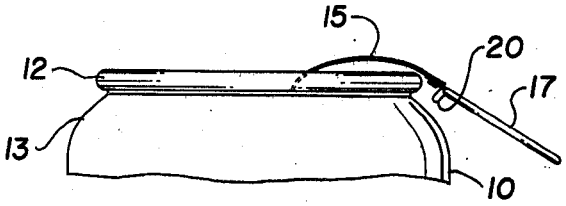

The opening sequence is continued by drawing the pull ring 17 across the top of the container toward the edge of the container end 11 opposite the first end of tab 15 as illustrated in FIGS. 6 and 7. As the ring is thus drawn, the tab 15 defined by the score line is progressively torn from the container end along the score line to form the opening 21.

Figure 9:
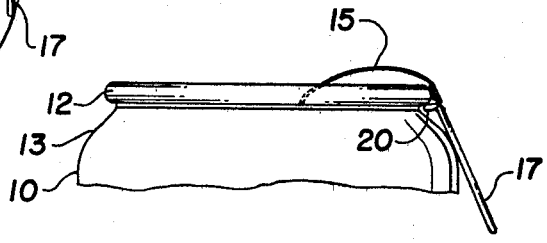

As illustrated in the drawings, the configuration of the score line preferrably defines a tab with a relatively narrow elongated neck 23 adjacent the second end 16 thereof. As the tab 15 is drawn across and progressively severed from the top of the container, the relatively thin neck 23 will naturally tend to curl inwardly toward the container end because of localization of the tear forces along the opposite edges of the neck 23. Accordingly, as illustrated in FIG. 7, the tab 15 tends to form a curl which, when withdrawn a sufficient distance, will extend past the edge of the container end 11. In the preferred embodiment, the opposed ends of the score line permit the tab 15 to be withdrawn at least a sufficient distance to position bosses 20 adjacent the bead 12 on the edge of the disc opposite the wide portion of the opening 21. With the bosses hooked under the bead, the ring 17 may be folded downwardly and the tab securely attached in an outwardly folded position away from the opening 21 as illustrated in FIGS. 8 and 9. Alternatively, the score line ends may extend further toward the edge of the container end disc than illustrated in the drawings and the tab withdrawn a further distance. In this case, the relatively narrow neck 23 will be even further elongated and the tab will further tend to curl inwardly and downwardly, positioning the first end of the tab 15 and the pull ring 17 adjacent the side wall of the container. Because of the natural curling tendency of the neck formed during the opening procedure, the tab will act as a spring which resiliently urges the first end of the tab 15 and ring 17 against the outside wall of the container 10 maintaining it away from the opening 21 and out of the way of the consumer.

From the foregoing it will be observed that the container opening apparatus of the invention is fully self-contained and may be readily fabricated using conventional methods. However, since the second end 16 of the tab 15 is not separable from the container end but instead forms a hinge, the tab is readily and conveniently folded about the hinge to hold the tab 15 and pull means in a position out of the way of the consumer. Nevertheless, the tab and the pull ring remain securely captured by the container and may not be separately discarded.

The apparatus described may be used in connection with various container ends but is particularly useful for container ends used in connection with beverages which contain dissolved gasses and the like. In such containers, cost of materials and manufacturing processes are extremely critical. Accordingly, reduction in amounts of materials used can result in vast savings because of the large numbers of such containers produced. The container ends are usually discs of aluminum or an aluminum alloy coated on the internal surface with a gas-impermeable shield material or the like. Since the cost of materials is critical, the container ends are usually formed as thin as possible. Therefore, reinforcing ridges 25 are commonly formed in the container ends in areas near the opening to be formed to reinforce the container end during the opening process. It should be further noted that in accordance with the invention the pull means is affixed to the tab at a location near the edge of the container end and extends toward the center in the manufactured condition as contrasted to conventional container ends wherein the pull means is affixed to the tab in a position centrally located in the container end and extends toward one edge. In such conventional container ends, the diameter of the container end 11 can be reduced to be no less than slightly larger than twice the length of the pull means. In accordance with the present invention, since the pull means is attached near the edge of the container end and extends toward the center in the manufactured condition, the diameter of the container end is not limited by the opening mechanism. In conventional manufacturing processes, it has been found that cost savings can be realized by reducing the diameter of the container end and necking the end of the container to form a reducing neck 13 as illustrated in the drawings. Accordingly, the opening apparatus of the invention advantageously lends itself to further reduction in the diameter of the container end, thus advantageously permitting further cost reduction in the manufacture of such containers.

From the foregoing it will be observed that the container end and integral opening means of the invention may be readily and inexpensively manufactured for use in connection with various containers, regardless of size or intended use. However, since the tab is captured, it may not be separately discarded to form an ecological hazard. Furthermore, since the tab is severed from the container end by drawing the first end of the tab outwardly, no portion of the tab enters the interior of the container. Therefore the problems associated with inwardly deflected tabs are totally eliminated. Similarly, since the opening sequence is substantially the same (except for rotation of the pull means) as that used in conventional discardable tab arrangements, the mechanism is extremely simple to operate and will be readily accepted by the purchasing public. The size and shape of the opening formed may be varied as desired to conform to the intended use of the container. As shown in the embodiment described, the ends of the score line may flare outwardly from each other to prevent the tab from being accidently severed completely from the container end. Likewise, the position of the ends of the score line with respect to the center of the disc may be varied as desired to increase or decrease the length of the tab 15. If desired, the second end 16 of the tab 15 may terminate at the edge of the disc in which case the entire tab could be folded over the bead to extend down the side of the container 10. Since the location of the second end 16 determines the length of the tab 15, it will be recognized that it is only necessary that the second end 16 be displaced a sufficient distance from the center of the container end to form a tab 15 of sufficient length to extend past the bead 12 when the opening is formed. It is to be understood, therefore, that although the invention has been described with particular reference to specific embodiments thereof, the forms of the invention shown and described in detail are to be taken as preferred embodiments of same, and that various changes and modifications may be resorted to without departing from the spirit and scope of the invention as defined by the appended claims.

What is claimed:

1. A container end with integral opening means comprising:

(a) a substantially flat and substantially circular disc adapted to form the end of a container;

(b) a weakening score with spaced apart ends formed in said disc defining a partially removeable elongated tab having a first end and a second end and extending across the face of said disc with the first end of said tab positioned relatively near one edge of said disc and the second end of said tab positioned substantially diametrically disposed from said first end and between the geometric center of said disc and the opposite edge, the space between said spaced apart ends of said score defining said second end;

(c) pull means comprising an elongated body with a substantially flat edge portion extending therefrom; and (d) attachment means securing said substantially flat edge portion of said pull means to said elongated tab near said first end thereof permitting said substantially flat edge portion of said pull means to rotate about said attachment means in a plane substantially parallel with the plane of said substantially circular disc;

whereby said pull means may be rotated to a position between said attachment means and the edge of said disc nearest said first end of said tab to draw said first end outwardly from said container to a position adjacent the opposite edge of said disc.

2. A container end as defined in claim 1 wherein said first end of said tab is wider than said second end.

3. A container end as defined in claim 1 wherein said weakening score defines a relatively narrow tab section at the extreme first end of said tab.

4. A container end as defined in claim 3 wherein said relatively narrow tab section is a narrow curved extension of said first end of said tab.

5. A container end as defined in claim 1 wherein said elongated body is a ring.

6. A container end as defined in claim 1 wherein said pull means is pivotal outwardly from said disc by bending said substantially flat edge portion to a position wherein the major portion of said pull means is disposed in a plane substantially 90° from said edge portion.

7. A container end as defined in claim 1 including means for securing said pull means to the edge of said disc opposite said first end of said tab after the first end of said tab has been severed from said container end.

8. A container end as defined in claim 6 including at least one boss member extending from said pull means, said boss member pivotal with said pull means and having an end extending outwardly therefrom when said pull means is positioned parallel with said substantially circular disc and extending substantially parallel with said substantially circular disc when said pull means is pivoted outwardly to a position approximately 90° from said substantially circular disc.

9. A container end as defined in claim 8 wherein said at least one boss member comprises two boss members, one positioned on each side of said edge portion rotatably secured to said tab.

10. A container end as defined in claim 1 wherein said portion of said tab adjacent said first end thereof is substantially wider than the portion thereof adjacent said second end thereof.

11. A container end as defined in claim 1 wherein said weakening score defines an elongated tab with a substantially elongated relatively narrow portion adjacent said second end.

* * * * *

UNITED STATES PATENT AND TRADEMARK OFFICE

CERTIFICATE OF CORRECTION

PATENT NO. : 4,397,403

DATED : August 9, 1983

INVENTOR(S) : Henry L. Guimarin

It is certified that error appears in the above-identified patent and that said Letters Patent are hereby corrected as shown below:

In Column 3, line 26, "or" should read ---of---

In Column 3, line 35, "rotatbly" should read ---rotatably---

In Column 8, line 10, "said" should read ---the---

Signed and Sealed this

*Twenty-fifth* Day of *October 1983*

[SEAL]

*Attest:*

GERALD J. MOSSINGHOFF

*Attesting Officer*

*Commissioner of Patents and Trademarks*